US005092629A

United States Patent [19]

Bagneres et al.

[11] Patent Number: 5,092,629

[45] Date of Patent: Mar. 3, 1992

[54] SYSTEM FOR LINKING A SKI POLE TO A SKIER'S HAND

[75] Inventors: Olivier Bagneres, Seynod; Alain Bejean, Alby sur Chéran; Didier Rousset, Lescheraines, all of France

[73] Assignee: Salomon S.A., Annecy Cedex, France

[21] Appl. No.: 383,043

[22] Filed: Jul. 21, 1989

[30] Foreign Application Priority Data

Jul. 21, 1988 [FR] France ..... 88 10159

[51] Int. Cl.[5] ..... A63C 11/00

[52] U.S. Cl. ..... 280/821; 2/161 A

[58] Field of Search ..... 280/821, 822, 816, 809; 2/160, 161 A, 162

[56] References Cited

U.S. PATENT DOCUMENTS 3,232,632 2/1966 Lewis ..... 280/822
3,687,472 8/1972 Struble, Jr. ..... 180/181
4,653,121 3/1987 Kassal et al. ..... 2/160
4,698,851 10/1987 Dunford et al. ..... 2/160
4,742,579 5/1988 Dunford ..... 2/16

FOREIGN PATENT DOCUMENTS 376579 5/1984 Australia .
2381537 9/1978 France .

*Primary Examiner*—Andres Kashnikow
*Assistant Examiner*—Richard Camby
*Attorney, Agent, or Firm*—Sandler, Greenblum & Bernstein

[57] ABSTRACT

Apparatus and method for linking a ski pole to a hand of a skier. The apparatus has a hand cover that is placed over the hand of said skier. The hand cover includes a strap for transmitting forces of the skier to the ski pole. First and second connections secure the hand of the skier to a handle of the ski pole.

17 Claims, 3 Drawing Sheets

SYSTEM FOR LINKING A SKI POLE TO A SKIER'S HAND

BACKGROUND OF THE INVENTION

1. Field of the Invention

The present invention is directed to an apparatus and method for linking a ski accessory, such as a ski pole, to a skier's hand.

2. Description of Background and Relevant Information

Skiers typically employ ski poles to increase their balance and maneuvering ability. The ski poles are usually manufactured such that they include a closed loop strap, known as a wrist strap, proximate the topmost portion of the ski pole. Such a strap permits the skier to avoid losing his pole if he unexpectedly opens his hand. In addition, the wrist strap improves the transmission of forces by the skier, particularly when the skier is leaning on the pole, either for making a turn (in downhill skiing), or for the stride or skating step in cross-country skiing.

To be efficient, the wrist strap must partially encircle the skier's wrist with the two end strands of the loop connected to the wrist passing along the palm of the hand. However, the majority of skiers, and particularly novice skiers, do not position the wrist strap at the proper location, reducing the benefits of using ski poles. Furthermore, when the wrist strap is not properly positioned around the wrist, the forces exerted on the hand by the ski pole are localized, which can lead to discomfort and trauma for the skier.

In addition, in certain situations, such as in cross-country skiing, wherein the ski pole is moved from a propulsion position to a return position, the conventional wrist strap does not prevent one from losing the ski pole.

Other problems arise from poor placement and sliding of the conventional type wrist strap during skiing, such as the inability to adjust the wrist strap with respect to the skier's hand and the lack of feedback from the ski pole when thicker than normal gloves are worn due to the inefficient coupling of the hand to the ski pole.

French patent 2,381,537 discloses a ski pole with a handle having a shape in which the skier's hand is linked to the ski pole by a magnetic coupling device that is provided on a glove worn by the skier and on the ski pole. However, such a system does not solve all the problems described above; particularly the problems of transmitting the skier's forces to the ski pole and of not losing the ski pole, because a sudden shock to the ski pole releases the magnetic coupling.

Accordingly, an object of the present invention is to overcome the above described problems and particularly, to furnish a system for linking a ski accessory, such as a ski pole, with the skier's hand.

SUMMARY OF THE INVENTION

A linking assembly is provided according to the present invention, for linking a ski accessory, such as a ski pole, to a skier's hand. The linking assembly includes a hand cover in the shape of a glove, which is adapted to be slipped onto the skier's hand. The hand covering includes means for transmitting forces from the skier to the ski pole. A first means for affixing, associated with the ski accessory, cooperates with a second means for affixing, associated with the hand cover, to secure the ski accessory to the hand of the skier. The second means for affixing associated with the hand cover is positioned proximate the point of intersection of a thumb and index finger of the hand of the skier.

The means for transmitting forces includes a strap or the like having a closed loop that is integrated into the hand cover, such that the second means for affixing is arranged on the strap and projects toward the ski pole.

An advantage of the present invention is the ability to adjust the position of the second means for affixing with respect to the location of the first means for affixing associated with the ski pole.

Another advantage of the present invention is that the fixation means associated with the ski pole is easily released from the fixation means associated with the hand covering when the skier has a mishap.

Yet a further advantage of the present invention is that a means for transmitting forces includes a cuff adapted to encircle the wrist of the skier's hand so as to provide an improved coupling of the hand to the ski pole.

The cuff may be adjustable in length to accommodate different size hands, and may be open to improve the comfort of the linking assembly.

The means for transmitting forces is designed to extend along the back of the skier's hand and connect the fixation means to the cuff and also extend along a sharp edge of the skier's hand into the cuff as well as along the palm of the skier's hand which connects the fixation means to the part of the cuff extending along the sharp edge of the skier's hand.

Another advantage of the present invention is the provision of a hand cover that contains means for transmitting forces and a fixation device that connects the hand cover to the ski pole.

Another advantage of the present invention is the provision of a ski pole that includes a fixation means that cooperates with a linkage system on a hand cover.

The present invention includes an apparatus for linking a ski pole, having a handle, to a hand of a skier. A hand cover, such as a glove, is placed over the hand of the skier. The hand cover includes a strap for transmitting forces of the skier to the ski pole. The strap forms a closed loop which is integrated into the hand cover. First and second affixing means secure the hand of the skier to the handle of the ski pole to transmit forces from the skier to the ski pole. The first affixing means is secured to the ski pole proximate the handle of the ski pole. The first affixing means is associated with the ski pole, while the second affixing means is associated with the hand cover.

Another advantage of the present invention is that the hand cover includes means for adjusting the hand cover to the hand of the skier.

A feature of the present invention is that the first means for affixing is arranged in a zone adapted to be proximate the intersection of a thumb and index finger of the skier's hand. In this arrangement, the first means for affixing may be arranged on said strap.

An aspect of the invention is that the position of the first means for affixing may be adjusted with respect to the second means for affixing.

Yet a further advantage of the present invention is that the first and second means for affixing are releasable from each other.

The present invention includes a cuff, which may be adjustable, that encircles a wrist of the skier's hand and transmits forces to the ski pole. Furthermore, the cuff may be open and include two ends which are adapted to overlap each other so that the cuff can be adjusted to the size of the wrist of the skier. Means for gripping, such as a hook and loop fastener, secure the two ends together.

Another feature of the present invention is the inclusion of a band that extends along the back of the hand and connects the second means for affixing to the cuff. An extension may also be included that extends along a sharp edge of the hand to a band of the cuff. A second band may also be provided that extends along the palm of the hand and connects the second means for affixing to the extension. The two bands and extension are provided to facilitate the transmission of forces to the ski pole.

The present invention is directed to a linking assembly that includes a ski glove that is adapted to be linked to a ski pole, in which means for transmitting forces of a skier to the ski pole are provided along with means for affixing the transmitting means to the ski pole.

The linking assembly of the present invention links a ski glove having means for transmitting forces of a skier to a ski pole in which the ski pole includes means for affixing the ski pole to the transmitting means.

A method is disclosed for securing a ski accessory, such as a ski pole, to a hand of a skier. A first affixing means is placed proximate a topmost section of the ski accessory. A second affixing means, which may be adjustable, is positioned on the hand of the skier. The positioning of the second affixing means is then adjusted so that it is located proximate a point defined by the intersection of a thumb and index finger of the hand. Lastly, the second affixing means is secured to the first affixing means so that the ski accessory is secured to the hand of the skier.

The linkage assembly of the present invention secures a ski accessory, such as a ski pole, to a hand of a skier by providing a first means for affixing, which may be an opening, that is secured to a portion of the ski accessory, such as a handle of the ski pole. A cuff that may be adjustable is placed around a wrist of said hand and a band (that may also be adjustable) extend from the cuff. Second means for affixing, such as a tongue, are secured to the band and engage the first means for affixing, so as to secure the ski accessory to the hand of the skier. In addition, a hand cover, such as a glove, may be provided that is placed over the cuff and band. The second means for affixing is preferably located proximate a point defined by the intersection of a thumb and index finger of the hand.

If the cuff is adjustable, two end flaps are provided. One end flap may have a hook fastener while the second end has a loop fastener. The hook fastener is secured to the loop fastener to adjust the cuff to the wrist of the skier.

According to a method of the present invention, the second affixing means may be placed around a wrist of the hand of the skier. The second affixing means may include a cuff, which can be adjustable, that is placed around the wrist of the hand of the skier. In addition, the second affixing means can be a band, which may adjustable, having a tongue that engages the first affixing means. The tongue is positioned proximate the point defined by the intersection of the thumb and index finger of the hand of the skier.

BRIEF DESCRIPTION OF THE DRAWINGS

The invention is further explained in the description which follows, with reference to the drawings illustrating, by way of a non-limiting example, an embodiment of the invention wherein.

DETAILED DESCRIPTION OF THE PREFERRED EMBODIMENT

Figure 1:
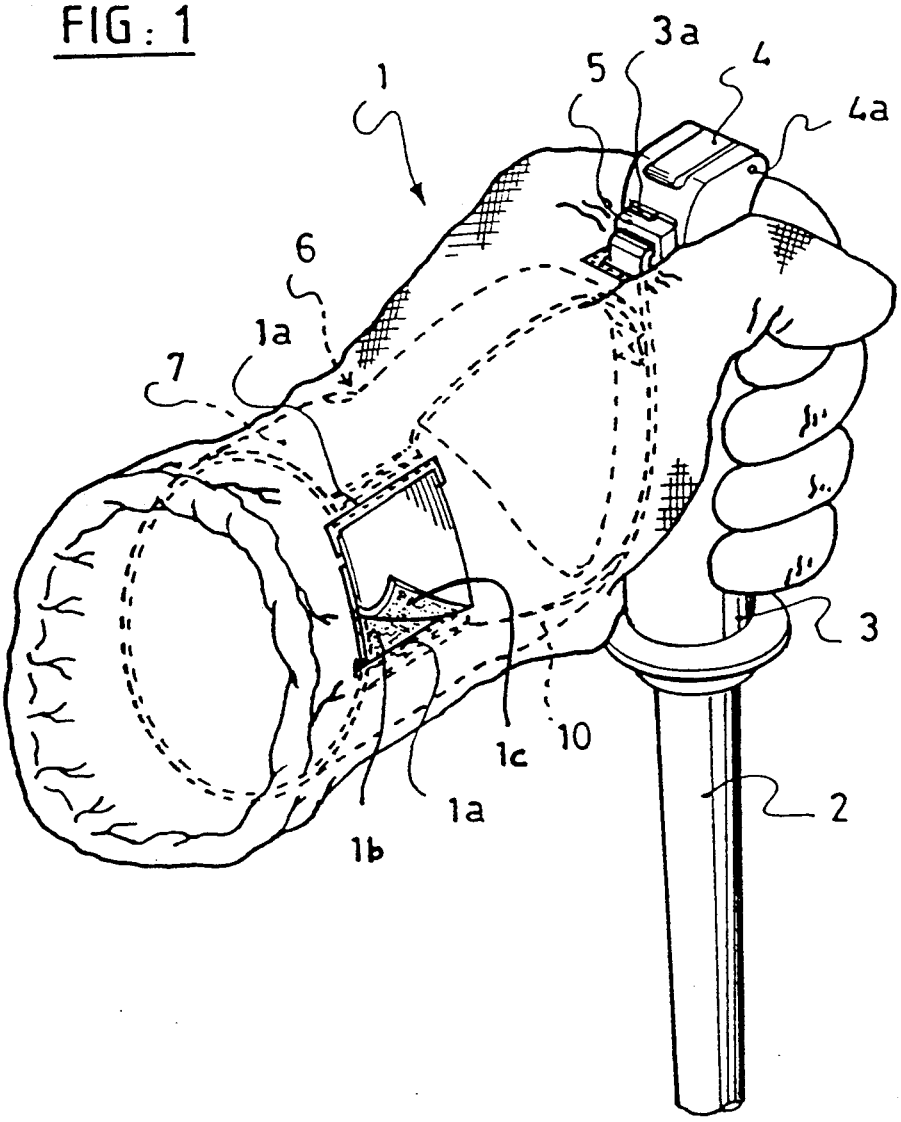
FIG. 1 is a perspective view of a linkage system according a preferred embodiment of the present invention, wherein the linking system is integrated into a ski glove.

A ski pole linkage assembly according to the present invention includes a hand covering, such as a glove 1, which is designed to be slipped onto a skier's hand 11. Glove includes means for transmitting the forces exerted by the skier to a ski pole 2. Glove 1 includes a first fixation means 5 that is intended to mate to a second fixation means 4 that is provided on handle 3 of ski pole 2. Such an assembly makes it possible to provide an adequate linkage between the skier's hand 11 and ski pole 2 to insure that the transmitting forces exerted on ski pole 2 by the skier are transmitted to ski pole 2. Linkage assembly eliminates the possibility of losing ski pole 2, even in cases where the skier releases his grip of handle 3 of ski pole 2.

Linkage assembly of the present invention is particularly advantageous to skiers who do not position conventional type wrist straps at the correct location with respect to the skier's hand, resulting in an inefficient transmittal of the skier's forces to ski pole 2, because fixation means 4 and 5 of the present invention will always be correctly adjusted for transmitting the skier's forces to ski pole 2.

Fixation means 4 and 5, associated with glove 1, are arranged in a zone adapted to be proximate the position of the intersection of the thumb and the index finger of the skier's hand. Such an arrangement is desirable for cross-country skiing, since it makes it possible to place linkage assembly proximate a center of rotation zone of ski pole 2 with respect to hand 11 during cross-country skiing.

According to a preferred embodiment, the means for transmitting forces includes a cuff 7 that is adapted to encircle the wrist of the skier's hand 11. Such an arrangement permits a correct distribution of forces when the skier leans on ski pole 2 while making a turn in downhill skiing or in a propulsion phase operation in cross-country skiing. In addition, the means for transmitting forces includes a member that extends along the back of the skier's hand 11 and connects fixation means 4 and 5 to cuff 7 of glove 1, making it possible to maintain good control of ski pole 2 during a return phase operation in cross-country skiing.

Finally, the means for transmitting forces can include an attaching member that extends along one edge of the skier's hand 11, extending to cuff 7, to improve the skier's ability to transmit the forces to ski pole 2. The attaching member is adapted to extend along the palm of the skier's hand 11 to connect fixation means 5 associated with glove 1 to fixation means 4 associated with ski pole 2, to provide a better distribution of the forces that are exerted on ski pole 2.

Linkage assembly according to the present invention is shown in FIG. 1. Linkage assembly secures hand 11 of a skier (shown in FIG. 2) that is wearing the hand covering, such as a glove 1, to handle 3 of a ski pole 2.

Linkage assembly includes a strap 6, or the like, which is integrated into glove 1 for transmitting to ski pole 2 the forces exerted by the skier. Glove 1 is selectively secured to handle 3 of ski pole 2 by a first fixation means 4 provided on the handle 3 of the ski pole and a second fixation means 5 provided on strap 6. The two fixation means 4 and 5 cooperate with each other.

In the preferred embodiment shown in FIGS. 1-5, second fixation means of strap 6 comprises a tongue 5 that projects towards the exterior of glove 1. Tongue 5 includes a hole 5*a*. Tongue 5 is introduced into an opening 3*a* in handle 3 of ski pole 2. The shape of opening 3*a* is designed to accept tongue 5.

First fixation means 4, which is associated with ski pole 2, comprises a cam 4 that is pivotally mounted at 4*a*. Tongue 5 is selectively locked by a means for locking (not shown), which is activated by pivotally mounted cam 4. Any suitable means for locking strap 6 to handle 3 of ski pole 2 can be used. In particular, it is possible to use a locking system having elastic spring linkages, since this has the advantage of unlocking in case of an accidental shock.

Second fixation means 5, associated with strap 6, is preferably positioned proximate a point 11*a* defined by the intersection of thumb 12 and index finger 13 of the skier's hand 11. Such a location is desirable because it makes it possible to place hand 11 of the skier and ski pole linkage assembly at a mutual rotation zone position of hand 11 and ski pole 2 during skiing. This location is particularly desirable for cross-country skiing in order to eliminate or reduce problems associated with the sport, such as the occurrence of blisters on the skier's hand 11 from the sliding action of ski pole 2.

Several modifications can be made to linkage assembly without diverging from the scope of the invention. For instance, a means for adjusting the length of fixation tongue 5 can be provided to adapt linkage assembly to the skier's hand 11.

Strap 6 is manufactured from a material exhibiting a suitable strength for the job and which also can be easily tolerated by the skin of hand 11. For instance, strap 6 can be manufactured using the same material used to manufacture conventional type ski pole wrist straps.

Strap 6 can have the shape of a conventional wrist strap or of that described below in connection with the drawings, the essential element being that it ensures a good transmission of the forces between the user's hand 11 and ski pole 2.

Figure 2:
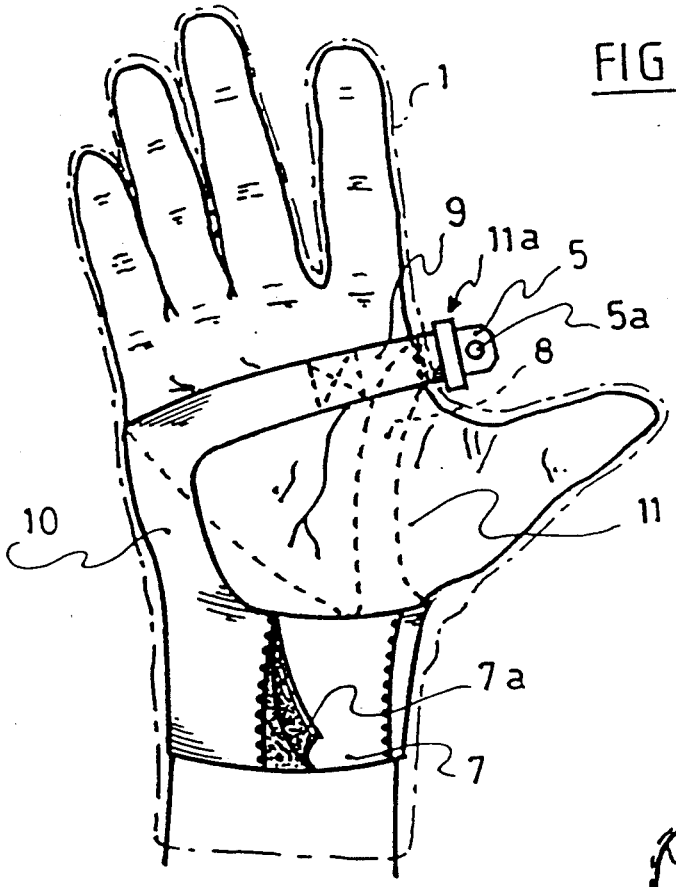
FIG. 2 is a bottom view of a means for transmitting forces used with the linkage system of the present invention, wherein a hand covering that is placed over a skier's hand is shown in broken lines.
Figure 3:
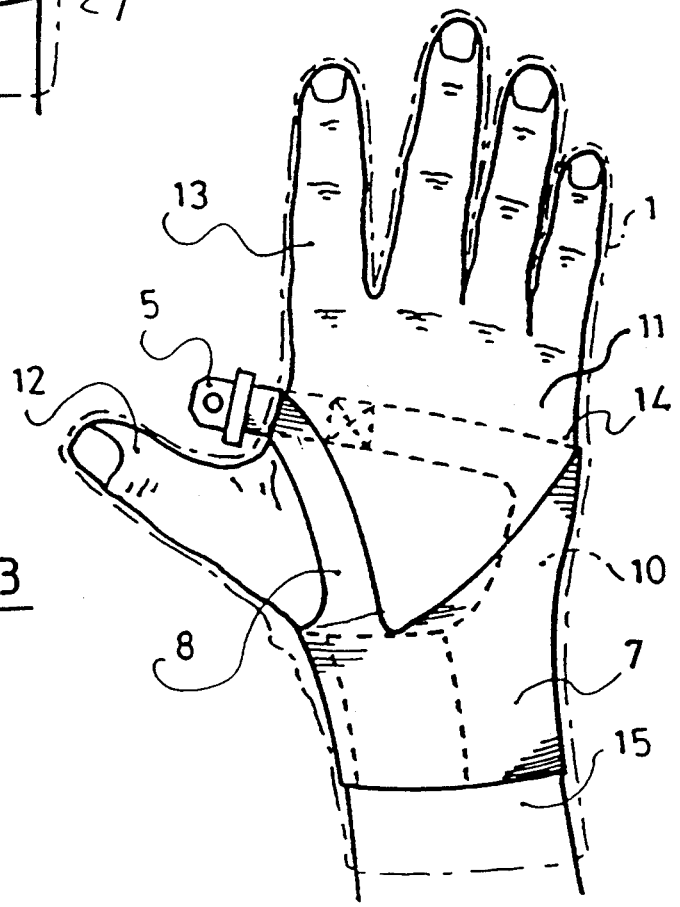
FIG. 3 is a top view of the means for transmitting forces shown in FIG. 2.

As shown in FIGS. 2 and 3, strap 6 includes a cuff 7 which is intended to encircle a wrist 15 of the skier. Cuff 7 can form either a continuous loop whose dimension corresponds to that of wrist 15, or it can be open. In the latter case, two ends 7*a* of cuff 7 are designed so as to extend out from hand covering 1 through slots la (see FIG. 1) provided therein. Two ends 7*a* are furnished with a means for gripping, such as a hook 1*b* and loop fastener 1*c*. Two ends 7*a* are closed by placing one end 7*a* over the other end 7*a* so that hooks 1*b* and loops 1*c* engage each other. Such an arrangement permits the cuff to be adapted to various sized wrists.

Cuff 7 extends laterally by an extension 10 that extends along sharp edge 14 of hand 11; i.e., the lateral portion of the hand opposite thumb 12. Extension 10 ensures that the forces exerted by the skier are properly distributed to ski pole 2, as will be explained in the description that follows.

Strap 6 includes a first band 8 that extends along the back of hand 11 (FIG. 3) to secure second fixation means 5 to cuff 7. As shown in FIG. 3, band 8 extends substantially along the journal zone of thumb 12 with the rest of hand 11 so as to not hinder movement of the hand.

Band 8 is adjustable in length, for example, by the use of a gripping means similar to that employed for cuff 7, so as to conform to the dimensions of the back of hand 11. This permits better precision in guiding ski pole 2. Band 8 should be as short as possible to avoid any play at the level of its fixation to handle 3 to obtain a better sensation of ski pole 2.

Strap 6 further includes a second band 9 that extends along the palm of hand 11 and secures fixation tongue 5 to extension 10 that covers sharp edge 14 of hand 11. Second band 9 indirectly connects fixation tongue 5 to cuff 7 along the palm of hand 11.

The operation of the various components of strap 6 for transmitting forces to ski pole 2 will now be explained with reference to FIGS. 4 and 5.

Figure 4:
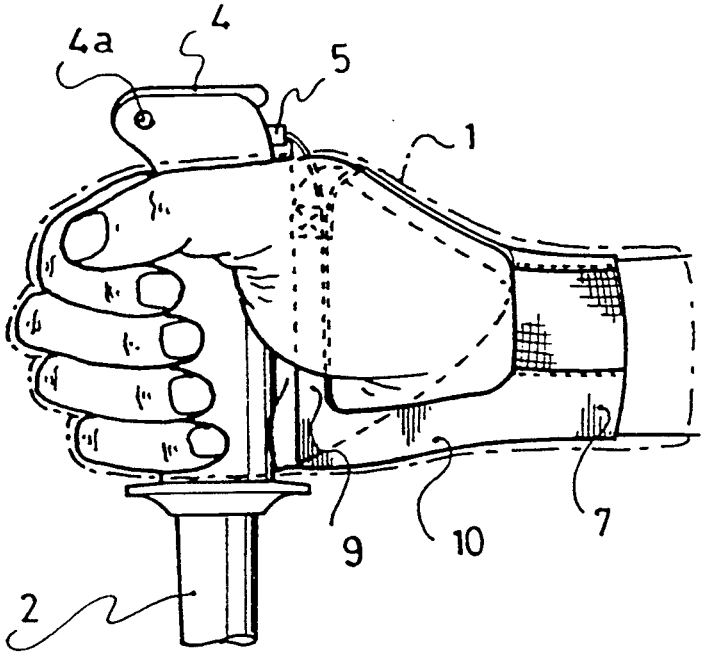
FIG. 4 illustrates a side view of the linkage system of the present invention for transmitting forces showing the position of the skier's hand in a leaning or propulsion phase of skiing, the hand covering being shown in broken lines.

FIG. 4 shows the position of the skier's hand in a propulsion operation phase in which a skier leans on ski pole 2, such as might occur while cross-country skiing or negotiating a turn in downhill skiing. In this operation phase, the force exerted by the skier is essentially transmitted to ski pole 2 by cuff 7 and extension 10 of strap 6 covering sharp edge 14 of hand 11. Second band 9, between cuff 7 and fixation tongue 5, also participates in the transmission of forces to ski pole 2. Strap 6 transmits forces to ski pole 2 better than conventional wrist straps, because of a better distribution or forces on the surface of hand 11. Furthermore, such an arrangement results in fewer risks of injury or trauma to hand 11.

Figure 5:
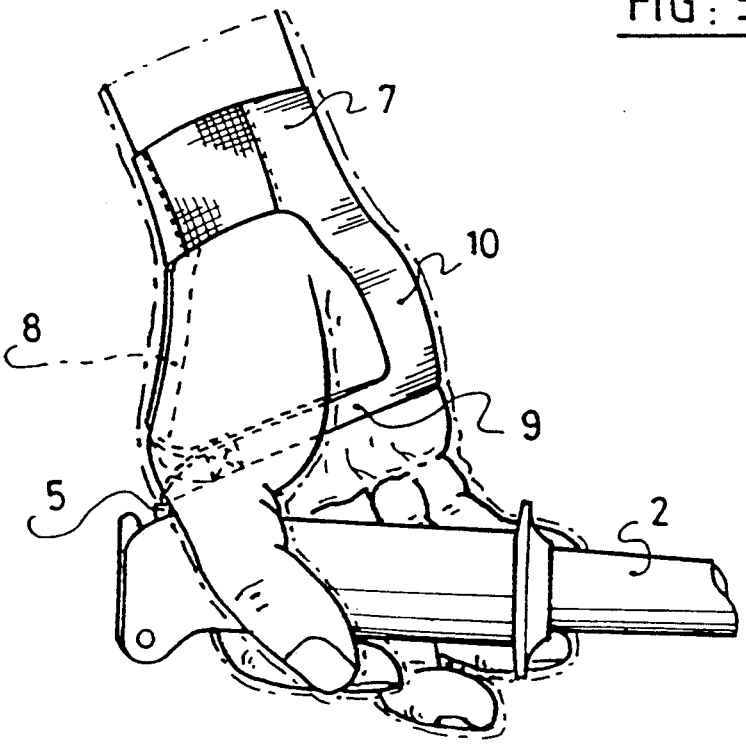
FIG. 5 is a view similar to FIG. 4 in which the ski pole is shown in a return phase.

FIG. 5 shows the position of the skier's hand in a return operation phase. This operation phase follows the propulsion operation phase in cross-country skiing. The skier is projected forward by leaning on ski pole 2. During this phase, the skier must bring ski pole 2 back towards the front so as to be able to lean on it again.

It is usually during this operation phase that the skier, using conventional type wrist straps, loses the ski pole, because at this point there no longer is any holding force exerted on the ski pole, because the ski pole is only held by the ends of the skier's fingers, as shown in FIG. 5.

With linkage assembly according to the present invention, band 8 of strap 6, which connects cuff 7 to ski pole 2 by means of fixation tongue 5, exerts a return retention force on ski pole 2. This guarantees that ski pole 2 will not separate from the skier, even though the skier is not applying a holding force to ski pole 2 with his fingers. In the return operation phase the various components of strap 6 distribute the forces generated by the inertia of ski pole 2 to hand 11.

As can be seen, linkage assembly according to the present invention makes it possible to solve the problems that plague conventional type wrist straps. Assembly permits a good transmission of forces from the skier to ski pole 2. Additionally, the problem of how to position the wrist strap is solved. This feature is very beneficial to novice skiers. Furthermore, linkage assembly equalizes and permits a regular distribution of forces, avoiding trauma and hand injuries. The present invention also avoids the problems connected with the relative rotation of ski pole 2 and glove 1 during cross-country skiing.

Integration of strap 6 into glove 1 enhances interfacing of assembly, without requiring any adjustment of strap 6, to hand 11. The interfacing can even be improved with the addition of a means for adjusting the location of the wrist via cuff 7 and the location of fixation means 5.

Assembly according to the present invention also makes it possible to prevent losing ski pole 2, particularly in the return phase of cross-country skiing, since ski pole 2 is automatically brought back by hand 8.

Finally, the present invention permits the skier to obtain better feedback from ski pole 2, since the transmission of forces between the skier and ski pole 2 is positioned closer to the skin by integrating strap 6 within glove 1.

It should be noted that linking assembly also promotes safe skiing by providing a releasable fixation means in the case of a shock to ski pole 2 or fall by the skier.

It is understood that the present invention is not limited to the embodiment shown in the drawings, which illustrate a non-limiting example. For example, glove 1 could be eliminated without affecting the operation of linking assembly. In such an embodiment, assembly would merely comprise a sheath having an appropriate shape furnished with fixation means.

Alternatively, an additional covering can be provided between the skier's hand and the portion of the strap that transmits the forces to and from ski pole 2.

Finally, any fixation means located between the portion that transmits forces to ski pole 2 and handle 3 of ski pole 2 can be used without diverging from the scope of the invention.

We claim:

1. An apparatus for linking a ski pole, having a handle, to a hand of a skier, comprising:

a hand cover having means for transmitting forces of said skier to said ski pole, said hand cover being placed over the hand of a skier;

first means for affixing said hand cover to said handle of said ski pole; and second means for affixing said hand cover to said handle of said ski pole, said second means for affixing engaging said first means for affixing to permit the transmission of forces from said hand cover to said ski pole, wherein said means for transmitting forces comprises a cuff adapted to encircle a wrist of said skier's hand, and a band attached to said cuff and extending from said cuff along said hand cover at the back of said hand and connecting said second means for affixing to said cuff.

2. The apparatus of claim 1, further comprising a second band attached to said cuff and extending from said cuff along said hand cover at the palm of said hand and connected to said second means for affixing.

3. An apparatus for securing a ski accessory to a hand of a skier, comprising:

a hand covering;

first means for affixing being secured to a portion of said ski accessory;

a cuff that is placed around a wrist of said hand;

a band extending from said cuff and from within said hand covering and through said hand covering;

a second means for affixing being secured to said band, said second affixing means engaging said first means for affixing so as to secure said ski accessory to said hand of said skier.

4. The apparatus of claim 3, further comprises a hand cover that is placed over said cuff and band.

5. The apparatus of claim 4, wherein said hand cover comprises a glove.

6. The apparatus of claim 3, wherein said second means for affixing comprises a tongue.

7. The apparatus of claim 5, wherein said first means for affixing includes an opening for receiving said tongue.

8. The apparatus of claim 3, wherein said cuff is adjustable about said wrist of said skier.

9. The apparatus of claim 3, wherein said band is adjustable about said hand of said skier.

10. The apparatus of claim 3, wherein said hand covering comprises material having an opening through which said band extends, and further wherein said second means for affixing is located proximate a point defined by the intersection of a thumb and index finger of said hand.

11. The apparatus of claim 6, wherein said tongue is located proximate a point defined by the intersection of a thumb and index finger of said hand.

12. The apparatus of claim 8, wherein said adjustable cuff has two end flaps, one end flap having a hook fastener and the second end having a loop fastener, said hook fastener being secured to said loop fastener to adjust said cuff.

13. The apparatus of claim 3, wherein said cuff is adjustable about said wrist of said skier.

14. The apparatus of claim 13, wherein said adjustable cuff has two end flaps, one end flap having a hook fastener, the second end having a loop fastener, said hook fastener being secured to said loop fastener to adjust said cuff.

15. The apparatus of claim 3, wherein said ski accessory comprises a ski pole.

16. The apparatus of claim 15, wherein said first means for affixing is secured to a handle of said ski pole.

17. The apparatus of claim 16, wherein said cuff is adjustable, said cuff having two end flaps, one end flap having a hook fastener, the second end having a loop fastener, said hook fastener being secured to said loop fastener to adjust said cuff to said wrist of said skier.

* * * * *